US007601078B2

(12) United States Patent
Mergy et al.

(10) Patent No.: US 7,601,078 B2
(45) Date of Patent: Oct. 13, 2009

(54) GOLF CLUB HEAD WITH NON-METALLIC BODY

(75) Inventors: Jeffrey T. Mergy, Youngtown, AZ (US); Anthony D. Serrano, Anthem, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 202 days.

(21) Appl. No.: 11/693,490

(22) Filed: Mar. 29, 2007

(65) Prior Publication Data

US 2008/0242445 A1 Oct. 2, 2008

(51) Int. Cl.
*A63B 53/04* (2006.01)

(52) U.S. Cl. ..... 473/345; 473/349

(58) Field of Classification Search ..... 473/324–350, 473/287–292

See application file for complete search history.

(56) References Cited

U.S. PATENT DOCUMENTS

| | | | | |
|---|---|---|---|---|
| 1,452,845 | A * | 4/1923 | Pryde | 473/343 |
| 2,447,967 | A * | 8/1948 | Stone | 473/332 |
| 4,193,601 | A * | 3/1980 | Reid et al. | 473/342 |
| 4,930,781 | A * | 6/1990 | Allen | 473/346 |
| 5,292,129 | A * | 3/1994 | Long et al. | 473/346 |
| 5,328,176 | A * | 7/1994 | Lo | 473/342 |
| 5,665,014 | A | 9/1997 | Sanford et al. | |
| 5,776,011 | A * | 7/1998 | Su et al. | 473/345 |
| 5,851,160 | A | 12/1998 | Rugge et al. | |
| 6,381,828 | B1 * | 5/2002 | Boyce et al. | 29/527.4 |
| 6,471,604 | B2 * | 10/2002 | Hocknell et al. | 473/334 |
| 6,575,845 | B2 * | 6/2003 | Galloway et al. | 473/329 |
| 6,623,378 | B2 * | 9/2003 | Beach et al. | 473/345 |
| 6,739,983 | B2 * | 5/2004 | Helmstetter et al. | 473/342 |
| 6,783,466 | B2 | 8/2004 | Seki et al. | |
| 7,063,628 | B2 | 6/2006 | Reyes et al. | |
| 2002/0091015 | A1 | 7/2002 | Seki et al. | |
| 2006/0089207 | A1 | 4/2006 | Galloway et al. | |

FOREIGN PATENT DOCUMENTS

| | | |
|---|---|---|
| JP | 7-155410 | 6/1995 |
| JP | 2003-230643 | 8/2003 |
| JP | 2004-357978 | 12/2004 |
| WO | WO 2004/089475 | 10/2004 |

* cited by examiner

*Primary Examiner*—Sebastiano Passaniti

(57) ABSTRACT

A golf club includes a head having a front body preferably made of metallic material and a rear body preferably made of non-metallic material. The front and rear bodies are constructed so that a crown wall on the front body has a protruding section that mates with a recessed section of a crown wall on the rear body. The protruding section of the crown wall on the front body lies in a region of the club head that experiences the highest deflection and stress during impact with a golf ball. Therefore, the club head behaves, during impact with a golf ball, substantially as if the rear body were formed of metallic material rather than non-metallic material.

22 Claims, 3 Drawing Sheets

GOLF CLUB HEAD WITH NON-METALLIC BODY

BACKGROUND

This invention relates generally to golf equipment and, in particular, to golf clubs.

Recent developments in golf club design have included improvements in drivers which are used primarily to strike a golf ball resting on a golf tee. These improvements have resulted in drivers with club heads consisting of a hollow shell usually made of metal such as steel, aluminum, or titanium. One example of a golf club head consisting of a hollow metal shell is disclosed in U.S. Pat. No. 5,851,160 to Rugge et al. In an effort to obtain improved performance from these drivers, golf club designers have increased club head volume from a moderate volume of 250 cubic centimeters as disclosed in Rugge et al. to over 400 cubic centimeters in recent years. The striking face of these drivers must have a certain minimal thickness in order to withstand the forces generated upon impact with a golf ball. Accordingly, as club head size increases, less material is available for fabricating the crown, sole and skirt of the club head while maintaining the club head of these drivers within acceptable weight limitations of approximately 200 grams.

More recent drivers have included club heads with metallic striking faces and aft bodies composed of non-metallic material such as composite or thermoplastic. An example of these drivers is disclosed in U.S. Pat. No. 6,471,604. Since a metallic striking face and a non-metallic aft body are usually joined together in the most highly stressed region of the club head crown, the striking face may not be adequately supported. Consequently, more metal must be used in the striking face thereby canceling out much or all of the weight savings attributable to the non-metallic aft body. Accordingly, what is needed is a club head having a metallic front body and a non-metallic rear body joined together in a region of the club head crown that is not under high stress upon impact with a golf ball.

DRAWINGS

DESCRIPTION

Figure 1:
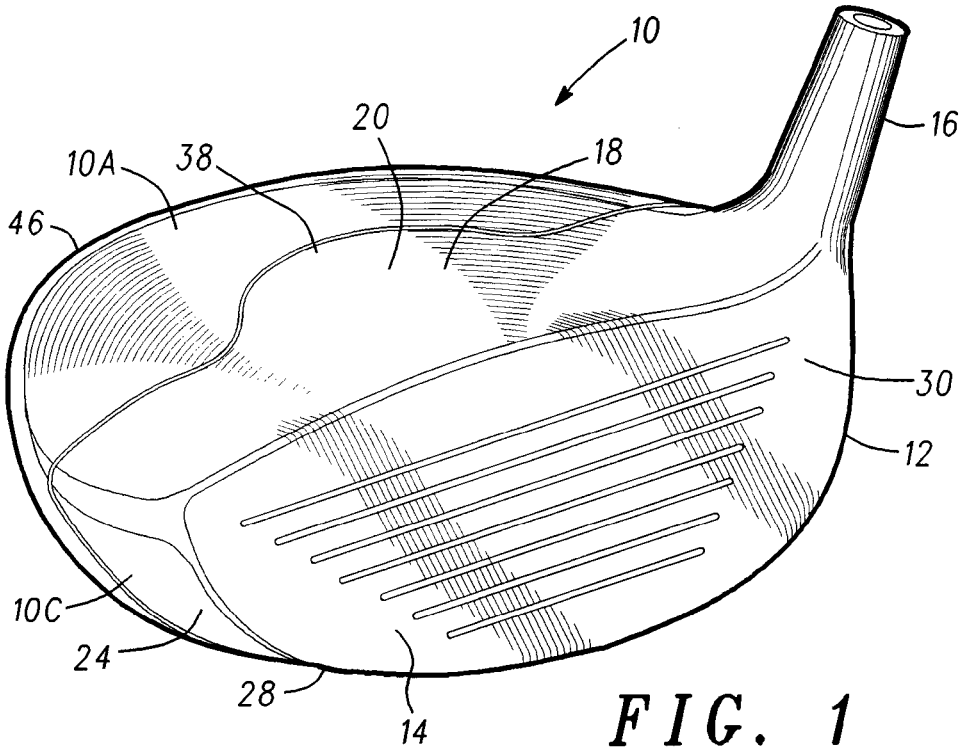
FIG. 1 is a front perspective view of a golf club head incorporating features of the present invention.
Figure 2:
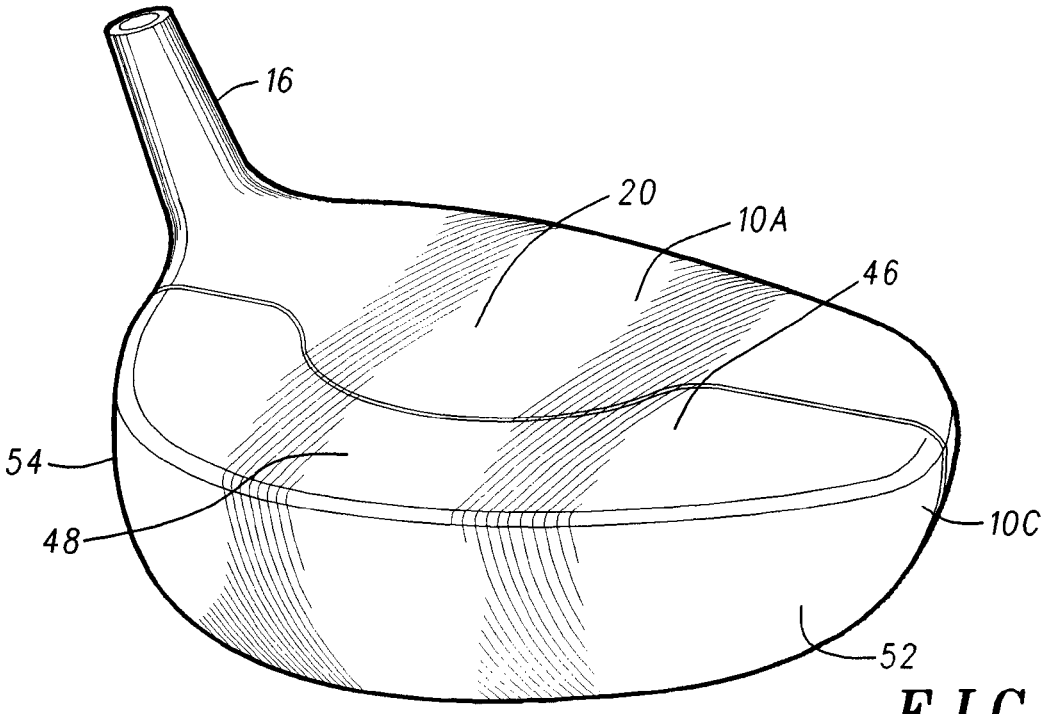
FIG. 2 is a rear perspective view of the golf club head of FIG. 1.

With reference to FIGS. 1-6, and in particular FIGS. 1-4, a golf club head 10 has a crown 10A, a sole 10B and a skirt 10C extending between the crown 10A and the sole 10B. The golf club head 10 comprises a front body 12 preferably formed of metallic material having a front wall 30 including a face 14 for impacting a golf ball. Front body 12 is generally cup-shaped and comprises a hosel 16 adapted to receive a golf club shaft (not shown). Front body 12 further comprises a rear extension 18 formed by a forward crown wall 20, a forward sole wall 22, a forward toe wall 24 and a forward heel wall 26, each of which is attached, respectively, to a perimeter region 28 of front wall 30.

Front body 12 may be assembled from a series of forged metal pieces that are welded or brazed together, or a single unitary forging, but in the illustrative embodiment of FIGS. 1-6, front body 12 comprises a single cup-shaped titanium investment casting.

Figure 3:
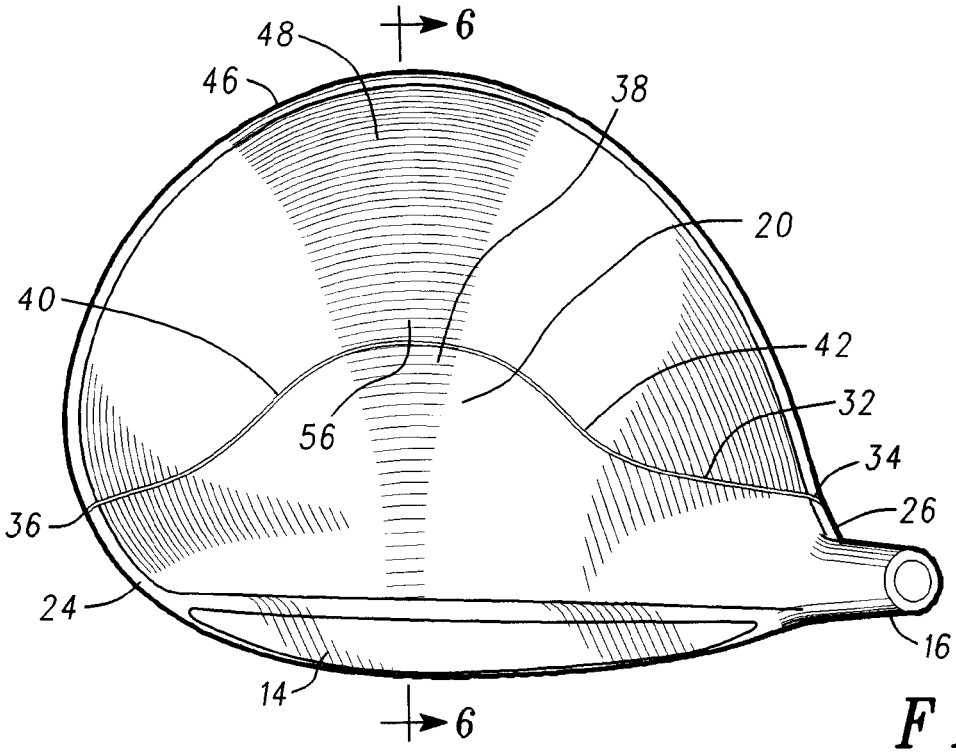
FIG. 3 is a top view of the golf club head of FIG. 1.
Figure 4:
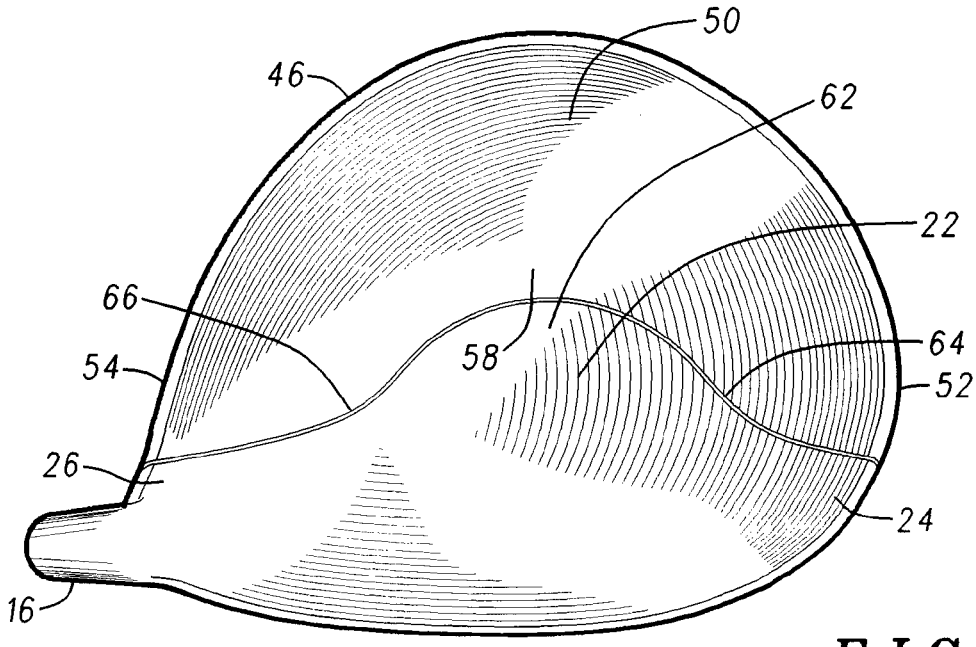
FIG. 4 is a bottom view of the golf club head of FIG. 1.
Figure 5:
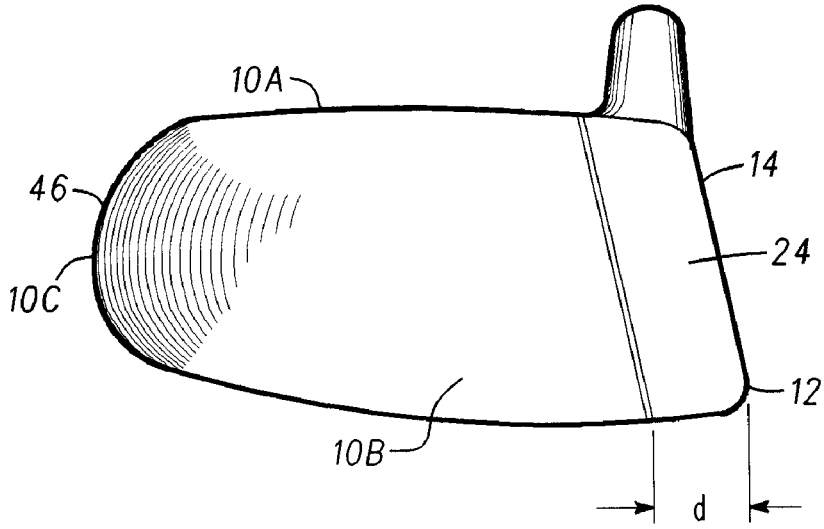
FIG. 5 is a toe-end view of the golf club head of FIG. 1.

With reference in particular to FIGS. 3 and 4, rear edge 32 of forward crown wall 20 tapers gradually rearward toward the center line of club head crown 10A from its heel and toe ends 34 and 36, respectively. Forward crown wall 20 further includes a rearwardly protruding section 38 proximal a central region thereof as well as rearwardly recessed sections 40 and 42 that blend rearwardly protruding section 38 into the tapered portions of forward crown wall 20. The rearwardly protruding section 38 is preferably convex with a radius of curvature between 25 mm and 125 mm, more preferably between 50 mm and 100 mm, and an arc length between 12 mm and 50 mm. Rearwardly protruding section 38 bounds the region of the club head crown 10A that is under the highest stress and exhibits the highest deflection in an all-metal club head (not shown) of identical size and shape compared to the illustrative embodiment. The rear edge of protruding section 38 corresponds essentially to a nodal line of the first vibration mode of the club head crown 10A which, therefore, experiences little or no deflection during impact.

Golf club head 10 further comprises a generally cup-shaped rear body 46 composed of a rearward crown wall 48, a rearward sole wall 50, a rearward toe wall 52 and a rearward heel wall 54. The rearward crown wall 48 includes a forwardly recessed section 56 proximal a central region thereof that is preferably concave and mates with the rearwardly protruding section 38 of the front body 12. Rear body 46 may be composed of a material that is of lower density than the metallic material forming the front body 12. This lower density material may be a lightweight, non-metallic material such as thermoplastic, thermoset plastic, or preferably fiber reinforced resin such as fiberglass-epoxy, fiberglass-polyester, ceramic-fiber epoxy, aramid-epoxy or other composites. Preferably, the non-metallic material comprises graphite-epoxy, which is preformed into the shape of rear body 46. The forward edges of crown, sole, toe and heel walls 48-54 of rear body 46 are sized to fit the contours of the rear edges of the forward crown, sole, heel and toe walls 20-26 of front body 12 so that the front and rear bodies 12, 46 cooperate to form the club head 10 as a substantially hollow structure.

What the inventors of the present invention discovered was that the remainder of the rear extension 18 outside of the protruding section 38 is under very low stress. Therefore, if the transition between the metallic front body 12 and the non-metallic rear body 46 is located behind this boundary, or within approximately a 20 mm or preferably a 10 mm band around this boundary, the crown 10A of the club head 10 behaves during impact substantially as if the club head 10 were made entirely of metal. Accordingly, a golf club head constructed in accordance with the teachings of the present invention maintains the desirable dominant natural frequency of at least 3,500 Hz. and the sound quality is not substantially damped by the presence of the non-metallic rear body 46 while retaining the weight advantages of a part-composite club.

Figure 6:
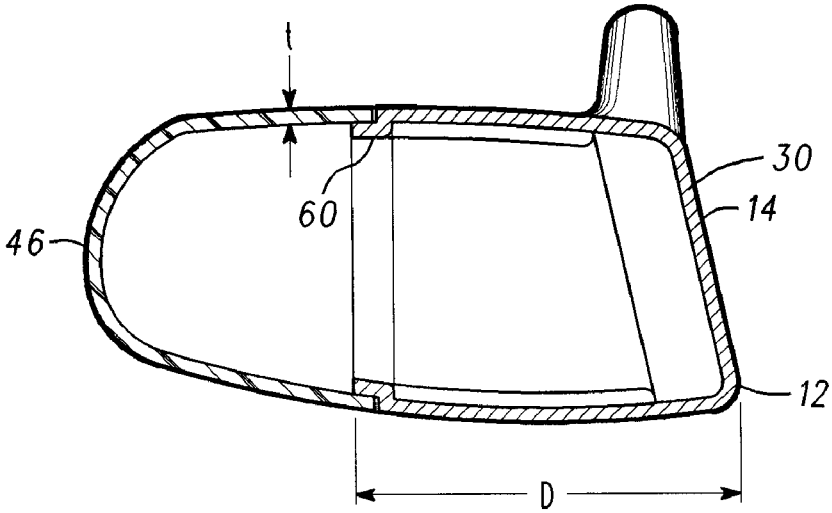
FIG. 6 is a cross-sectional view of the golf club head taken along line 6-6 in FIG. 3.

As shown in FIG. 6, front body 12 includes a stepped region or lip 60 that is stepped inward a distance equal to the thickness "t" of the crown, sole, toe and heel walls 48-54 of rear body 46. Rear body 46 is attached to front body 12 along the lip 60 by means of epoxy or other adhesive well known in the art applied to the interface between an inner surface of rear body 46 and an outer surface of lip 60. Alternatively, rear body 46 may have an inwardly stepped lip to attach to an inside surface of front body 12.

As shown in the illustrative embodiment, forward toe wall 24 and forward heel wall 26 of front body 12 extend a distance "d" of greater than 13 mm, preferably greater than 20 millimeters and most preferably about 25 millimeters from the face 14 of front body 12. Rearwardly protruding section 38 of front body 12 extends beyond distance "d," preferably a distance "D" at least 30 mm, more preferably at least 40 mm and most preferably at least 60 mm rearward of face 14 of front body 12.

Optionally, as shown in FIG. 4, forward sole wall 22 of front body 12 may also include a rearwardly protruding section 62 which may correspond in size and shape to rearwardly protruding section 38 of forward crown wall 20 and may include corresponding rearwardly recessed sections 64 and 66. Likewise, rearward sole wall 50 of rear body 46 may include a rearwardly recessed section 58 that mates with the rearwardly protruding section 62 of front body 12.

By incorporating non-metallic rear body 46 with metallic front body 12 having rear extension 18, club head 10 of the illustrative embodiment shown in FIGS. 1-6 is in excess of 400 cubic centimeters in volume with the front body 12 weighing from 150 to 170 grams and the rear body 46 weighing from 10 to 40 grams. In doing so, the face 14 can be increased to at least 5.00 square inches (preferably approximately 5.30 square inches) with a maximum thickness of between 0.110 and 0.160 inches proximal to the geometric center of the face 14 tapering downward to a thickness of 0.070 to 0.090 inches towards the perimeter region 28 of face 14. This is accomplished without sacrificing structural integrity of club head 10 and without exceeding the desired total weight of about 200 grams for club head 10. Moreover, the rearwardly protruding section 38 of forward crown wall 20 provides support for the face 14 not present in composite back body designs wherein the metal-to-composite seam is forward of the region identified in the illustrative embodiment. All of this is accomplished while maintaining the desirable dominant natural frequency of at least 3,500 Hz and without the sound damping normally associated with pure composite back body designs.

What is claimed is:

1. A golf club head comprising:

a front body having a heel and a toe, said front body including a front wall having a face for impacting a golf ball and a rear extension extending rearward from said front wall, said rear extension defining a forward crown wall, said forward crown wall having a rear edge that tapers such that said forward crown wall is narrowest proximal the heel and toe of said front body and widest proximal a central region of said forward crown wall;

said rear extension further comprising a forward sole wall, a forward toe wall and a forward heel wall;

said forward crown wall having a rearwardly protruding section proximal a central region thereof; and a rear body attached to said front body, said rear body including a rearward crown wall, a rearward sole wall, a rearward toe wall and a rearward heel wall, said rearward crown wall having a forwardly recessed section proximal a central region thereof that mates with said rearwardly protruding section of said forward crown wall on said front body, wherein said front and rear bodies cooperate to form a substantially hollow structure.

2. The golf club head of claim 1, wherein said rearwardly protruding section of said forward crown wall is at least half as wide as said face.

3. The golf club head of claim 1, wherein said front body includes a hosel formed therein for receiving a golf club shaft.

4. The golf club head of claim 2, wherein said rear body is generally cup shaped.

5. The golf club head of claim 1, wherein said front body is made of a first material and wherein said rear body is made of a second material.

6. The golf club head of claim 5, wherein said first material is metallic material and wherein said second material is non-metallic material.

7. The golf club head of claim 1, wherein the rearwardly protruding section of said front body is convex with a radius curvature between 25 millimeters and 125 millimeters.

8. The golf club head of claim 1, wherein the rearwardly protruding section of said front body corresponds to a nodal line of the first vibration mode of the forward crown wall.

9. The golf club head of claim 1, wherein the rearwardly protruding section of said front body is convex with ah arc length between 12 millimeters and 50 millimeters.

10. The golf club head of claim 1, wherein the rearwardly protruding section of said front body extends at least 30 millimeters rearward from the face of said front wall.

11. The golf club head of claim 1, wherein the rearwardly protruding section of said upper rear edge extends at least 60 millimeters rearward from the face of said front wall.

12. The golf club head of claim 1, wherein said forward sole wall of said front body tapers such that said forward sole wall is narrowest proximal the heel and toe of said front body and widest proximal a central region of said forward sole wall and wherein said sole wall has a rearwardly protruding section proximal said central region of said forward sole wall.

13. The golf club head of claim 12, wherein the rearwardly protruding section of said forward sole wall has a substantially identical profile to the rearwardly protruding section of said forward crown wall.

14. The golf club head of claim 1, wherein: said rear extension of said front body further comprises an inwardly displaced lip; and said rear body is attached to said front body along said lip with an inner surface of said rear body joined to an outer surface of said inwardly displaced lip.

15. A golf club head comprising:

a front body having a heel and a toe, said front body including a front wall having a face for impacting a golf ball and a rear extension extending rearward from said front wall, said rear extension defining a forward crown wall, said forward crown wall having a rear edge that tapers such that said forward crown wall is narrowest proximal the heel and toe of said front body and widest proximal a central region of said forward crown wall;

said rear extension further comprising a forward sole wall, a forward toe wall and a forward heel wall;

said forward crown wall having a rearwardly protruding section proximal a central region thereof; and a rear body attached to said front body, said rear body including a rearward crown wall, a rearward sole wall, a rearward toe wall and a rearward heel wall, said rearward crown wall having a forwardly recessed section proximal a central region thereof that mates with said rearwardly protruding section of said forward crown wall on said front body, wherein said rearwardly protruding section of said forward crown wail is at least half as wide as said face.

16. The golf club head of claim 15, wherein said front body includes a hosel formed therein for receiving a golf club shaft.

17. The golf club head of claim 15, wherein said front and rear bodies cooperate to form a substantially hollow structure.

18. The golf club bead of claim 15, wherein said front body is made of metallic material and wherein said rear body is made of non-metallic material.

19. A golf club head comprising:

a generally cup shaped front body having a heel and a toe, said cup shaped body being made of metallic material including a front wall having a face for impacting a golf ball, said cup shaped front body further comprising a hosel for receiving a golf club shaft and a rear extension extending rearward from said front wall, said rear extension defining a forward crown wall, a forward sole wall, a forward toe wall and a forward heel wall, said forward crown wall having a rear edge that tapers such that said forward crown wall is narrowest proximal the heel and toe of said front body and widest proximal a central region of said forward crown wall, said forward crown wall further comprising a rearwardly protruding section proximal said central region of said forward crown wall; and a generally cup shaped rear body attached to said front body, said rear body being made of non-metallic material and including a rearward crown wall, a rearward sole wall, a rearward toe wall and a rearward heel wall, said rearward crown wall having a forwardly recessed section proximal a central region thereof that mates with said rearwardly protruding section of said forward crown wall on said front body.

20. The golf club head of claim 19, wherein said rearwardly protruding section of said forward crown wall is at least half as wide as said face.

21. The golf club head of claim 19, wherein said forward sole wall on said front body has a rearwardly protruding section proximal a central region thereof.

22. The golf club head of claim 21, wherein said rearward sole wall on said rear body has a rearwardly recessed section proximal a central region thereof that mates with the rearwardly protruding section of said forward sole wall on said front body.

* * * * *

UNITED STATES PATENT AND TRADEMARK OFFICE

CERTIFICATE OF CORRECTION

PATENT NO. : 7,601,078 B2
APPLICATION NO. : 11/693490
DATED : October 13, 2009
INVENTOR(S) : Mergy et al.

It is certified that error appears in the above-identified patent and that said Letters Patent is hereby corrected as shown below:

Title Page, Column 1 item 54 (Title), line 2, insert --REAR-- before the text reading "BODY"

Column 1, line 2, insert --REAR-- before the text reading "BODY"

Column 4, line 19 (Claim 9), delete "ah" and insert --an-- after the text reading "protruding section of said front is convex with"

Column 4, line 62 (Claim 15), delete "wail" and insert --wall-- after the text reading "rearwardly protruding section of said forward crown"

Column 5, line 1 (Claim 18), delete "bead" and insert --head-- after the text reading "The golf club head"

Signed and Sealed this

Twenty-sixth Day of January, 2010

David J. Kappos

David J. Kappos
*Director of the United States Patent and Trademark Office*